US007343302B2

(12) United States Patent
Aratow et al.

(10) Patent No.: US 7,343,302 B2
(45) Date of Patent: Mar. 11, 2008

(54) SYSTEM AND METHOD FOR EMERGENCY RESPONSE

(75) Inventors: Michael Aratow, Mountain View, CA (US); Craig P. Buxton, Point Richmond, CA (US); Christopher A. Peri, Point Richmond, CA (US)

(73) Assignee: Puresense Environmental Inc., Emeryville, CA (US)

( * ) Notice: Subject to any disclaimer, the term of this patent is extended or adjusted under 35 U.S.C. 154(b) by 228 days.

(21) Appl. No.: 10/365,019

(22) Filed: Feb. 11, 2003

(65) Prior Publication Data

US 2004/0008125 A1 Jan. 15, 2004

Related U.S. Application Data

(60) Provisional application No. 60/356,079, filed on Feb. 11, 2002.

(51) Int. Cl.
*G06Q 99/00* (2006.01)

(52) U.S. Cl. ..... 705/1

(58) Field of Classification Search ..... 705/1
See application file for complete search history.

(56) References Cited

U.S. PATENT DOCUMENTS 6,084,510 A * 7/2000 Lemelson et al. ..... 340/539.13
6,600,812 B1 * 7/2003 Gentillin et al. ..... 379/45
2003/0129578 A1 * 7/2003 Mault ..... 435/4

FOREIGN PATENT DOCUMENTS

JP 2004139216 A * 5/2004

OTHER PUBLICATIONS

Verton, Dan, "Bioterrorism fighters get ammo," Computerworld, v35n49, p. 1, Dec. 3, 2001.*
www.scenpro.com, obtained from Internet Archive Wayback Machine <www.archive.org>, Date Range: Feb. 23, 2001-Feb. 5, 2002.*
Graham-Rowe, Duncan, "Raising the alarm: The best defence against a bioterrorist attack is to spot the omens fast." New Scientist, v172, n2321, p. 6, Dec. 15, 2001.*
"Siemens Facilitiates Puublic Health Surveillance to Combat Bioterrorism." Business Wire, Jan. 28, 2002.*

* cited by examiner

*Primary Examiner*—Jonathan Ouellette
(74) *Attorney, Agent, or Firm*—DLA Piper Rudnick Gray Cary US, LLP

(57) ABSTRACT

This application describes an information and resource management system for collecting data from diverse sources and organizing multiple types of data and information to facilitate dynamic multi-dimensional displays that will enhance cognition and situational awareness for diverse user communities. This system may facilitate collaborative cross-agency research and response to public health and safety issues. The system will generate more rapid awareness of potentially critical situations and promote greater awareness of the cost and benefits of alternative courses of action across diverse agencies and organizations serving common populations and communities. The invention includes customized geographically enabled data collection tools and techniques, dedicated databases and parsing schemes that feed into customized data visualization and simulation engines that drive the display of context sensitive interactive environments on a wide variety of computing platforms. The invention provides a novel approach to inter-disciplinary information integration processing, visualization, sharing and decision-making in the domain of public health and safety, disaster management and mitigation.

15 Claims, 4 Drawing Sheets

SYSTEM AND METHOD FOR EMERGENCY RESPONSE

CROSS-REFERENCE TO RELATED APPLICATIONS

This application claims priority to U.S. Provisional Patent Application No. 60/356,079, filed on Feb. 11, 2002, which is fully and completely incorporated herein by reference.

FIELD OF THE INVENTION

This invention generally relates to a system and method for emergency response and more particularly, to a system and method for collecting data and information, and detecting, analyzing, organizing, and displaying the data and information, as well as coordinating and supporting collaborative research, responses and recovery to real or perceived emergency situations.

BACKGROUND OF THE INVENTION

In the aftermath of September 11, the United States' ability to effectively detect, confront and combat the use of biological agents such as plague, smallpox, anthrax and ebola as weapons of mass destruction has become the focus of well-founded government and public concern. Recent cases of anthrax confirm the threat's reality. As summarized in the New York Times series on Bio-Terrorism: "This intentional release of potentially lethal viruses or bacteria into the air, food or water supply—poses a daunting technical challenge to our public health infrastructure."

A bio-terrorist event may be detected when increasing numbers of people with similar symptoms seek treatment in hospital emergency departments, physician's offices, or clinics over a period of several hours, days, or weeks. But early clinical symptoms of infection for most bio-terrorism agents may be similar to common diseases seen by health care professionals every day. Early detection of these agents is paramount as only a narrow window of time is available for successful treatment and prophylaxis; otherwise mortality is high. Until ubiquitous biosensors are instituted, our most effective defense is early warning of an attack identified by index cases afflicted by a specific agent. Still, early detection may be the only solution if radically altered strains or new agents are deployed rendering agent specific biosensors or immunizations useless. Unfortunately, many of our public and private health care systems are ill prepared to assess whether the patient's symptoms are typical of an endemic disease (influenza, for example) currently circulating in the community or related to a natural or purposeful outbreak.

In California, the State's Department of Health Services (CDHS) is tasked to work with public health agencies in establishing the capacity to determine the etiology and source of an outbreak and to identify the most effective and efficient interventions that can protect public safety. CDHS faces a daunting challenge in coordinating an enormous cast of organizations and services associated with the identification, prevention, treatment and management of public health epidemics; these include the State's Office of Emergency Services (OES) and the Emergency Medical Services Authority (EMSA). Working with these two agencies directly or on the periphery are also the local health departments, emergency management organizations, facilities and supplies, physicians, surgeons, veterinarians, registered nurses, school nurses, infection control practitioners, medical examiners and many others. This challenge of interagency collaboration and coordination is amplified when considering the problem at a national level.

At all levels—federal, state and local—the National Electronic Disease Surveillance System (NEDSS), the Centers for Disease Control and Prevention (CDC), the Department of Health Services (DHS) and the multitude of other groups, systems and organizations necessarily involved share some common issues, including:

- Limited coordination and communication because of a lack of real time reporting structures and technology bridging affected agencies (e.g., the CDC, FBI, CIA, NSC, DOD, DOT, DOE, DOA, FENA, National Guard, FEMA, Justice Department, etc);
- Major breakdowns in the collection, collation, communication and comprehension of relevant data from hospitals, clinics, physician offices, schools, agriculture departments, slaughterhouses, and other disease portals in our communities;
- A deficit of directed public health officer information required to enhance the ability to detect and report suspicious syndromes;
- Limitation of experience working in collaborative groupware environments, supporting standards and promoting efficient, effective and timely intervention by all agencies; and
- A lack of integrated user interfaces that enhance visualization of large and often complex datasets to help officials rapidly recognize real threats and respond accordingly.

Bringing everyone together to reduce the incidence of transmission of infectious agents will depend on how rapidly early victims can be triaged, diagnosed, isolated when necessary, and treated. Early communication with local health departments will be essential in controlling or preventing, not only disease transmission, but also in the provision of public reassurance. How quickly local and state health departments can respond to the crisis will depend on how rapidly they are notified of a possible outbreak.

There is therefore a pressing need for both early warning systems to detect potential attacks on public health and safety and a means to organize and coordinate resources effectively and efficiently across diverse communities and populations.

For instance, it would be desirable to solve issues with:

Health care organizations that are not set up to share information, but instead gather, analyze and store information with the intention to be used only by their creators and in a reflective mode only.

The prevalence of different data types and schemes that hamper real time analysis and generate costs to aggregate, access and assess.

Ad hoc coordination that make post-event interventions difficult, expensive and potentially delayed.

The latest anthrax events have brought to our attention the weakness in our ability to gather and exchange information within our public health, safety and security institutions. Most of these systems gather information in a non-standard manner and process it with proprietary systems that are used primarily to perform historical analysis. This results in little aggregation of data that could be used to indicate and predict illness and deaths due to a possible bio-attack. In this particular example, without the ability to share information, collaboration by various agencies in response to a bio-threat is severely hampered. For instance, information about patients entering the health system is gathered in a singleuser manner and not shared outside the immediate health care delivery system involved.

Once information becomes available in real-time and is complemented by data from other venues, real-time analysis and prediction can be performed. In a bio-induced emergency, quick access to information is of the essence as well as the ability to predict how the hazard may spread. Timely information allows administrators to quickly and exactly contain hazards and effects.

Data is worth very little if it is not understood by those who need to access to it. Since many different disciplines will need to work together to advance our surveillance capabilities, we need to insure that the many different views of information, and how to interact with that information, are addressed. The health care industry is still using old paradigms of information display and interaction. Static text or simple graphics, with no interaction possible and no link to more sophisticated sets of information, will only continue to hamper any efforts in bio-surveillance. It would therefore be desirable to provide an advanced visualization system that will take into account several needs that are impediments to cognition and collaboration.

It would also be desirable to provide a system that will display information in a format that is most useful to the viewer. This will allow users to adapt to the system quickly with minimum training. Although there will be different ways to view information, everyone will have access to the same timely information. It would further be desirable to provide a system that will communicate a significant amount of information into a small area of computer monitor display real estate by application of innovative data presentation techniques. Time is always a limiting factor for professionals and improving their access to information and the amount per unit time are keys to improved surveillance, detection, analysis, responsiveness and overall resource management.

SUMMARY OF THE INVENTION

The present invention relates to a system that provides public health and disaster management officials and the affected public context sensitive information regarding the scope and scale of perceived or actual threats or disasters. In one embodiment, the invention integrates four specific modules: Surveillance—Knowledge Acquisition; Detection—Analysis and Visualization; Response—Rapid and Situation Specific; and Communication and Collaboration for Optimal Outcomes. Collectively, these four modules may generate a comprehensive view.

The simple yet powerful idea behind this invention is that for the first time ever, secure real-time cooperation and collaboration is made possible between multiple populations whose normal lines of communication are separated by jurisdiction, time, space and unique social, economic and political agendas.

One advantage of the invention is that it integrates information across widely disparate databases. Another advantage of the invention is that it analyzes this information in user-directed ways and displays of resultant queries in a multidimensional manner, including the use of geo-spatial representation and metaphorical icons. A further advantage of this invention is the sharing of these analyses within a real-time collaborative environment that is empowered by panoply of communication modalities. The immediately preceding advantage of the invention enables geographically separated users to visualize the same set of data while discussing its implications using communication modalities and to modify the views quickly; this confers the advantage of enhanced decision-making and improved situational awareness and outcomes.

In an exemplary embodiment of the invention serving as an early warning system of bio-terrorism or an epidemic, the system will perform key organizing functions, such as directing patients based on real-time traffic analysis to drug distribution centers for prophylaxis, identification of quarantined areas, and providing easily accessible protocols for home care provider treatment and isolation of affected individuals. Equally important, the solution will make timely, accurate and relevant information available to the general public, thus reducing strain on limited resources, while avoiding panic and helping to direct those in need to treatment centers, as necessary.

An exemplary embodiment of the system will directly support, enhance and extend the utility of efforts underway such as the NEDSS and CDC system, and the work being coordinated by departments of health services at the national, state and local levels.

This system may be embodied in a collaborative approach to respond to bio-terrorism and other disasters. For the first time, diverse communities of users can work through a dynamic visualization platform with unified access that respects the unique needs of different classes of users, deployable standards for integrating disparate sources of data and information, flexible methods to communicate across venues, rapid detection, analysis and alerts of critically significant trends and comprehensive views to rapidly respond effectively and efficiently across diverse areas.

Many of the agencies and organizations tasked with the challenges of public health and disaster mitigation are required to work from mutually exclusive views of problems. Each agency operates with its own unique data standards and supporting information systems, ranging from basic manual practices to more extensive use of online, automated and web-enabled applications.

The result is multiple, non-conforming methods, procedures and practices that cross federal, state and local agencies in their efforts to collect, analyze and display information as well as to communicate, respond and deploy finite resources. Bottlenecks appear within and across these agencies as people attempt to work together in understanding local events and in responding to them rapidly. At all levels, local, national and international, attempts to address bio-terrorism face monumental challenges as concerned parties work through the labyrinth of communication and resource channels at a time when actions must be rapid and based on one consistent view.

The system addresses many of the significant problems communities confront through a novel multiple-disciplinary approach achieved by the invention's unique communication and visualization system. The system's online applications are designed to greatly facilitate the needed changes in asynchronous and outdated practices.

In one exemplary embodiment of the system users are able to build intuitive, context sensitive visualizations of multidimensional data, coupled with secure online workspaces for communication and collaboration. This embodiment can greatly enhance and accelerate the ability of local, state and national organizations to monitor, detect, analyze and respond to bio-attacks and disasters.

According to one aspect of the present invention, a method for acquiring knowledge that entails multiple forms of input, collection and collation of data from diverse sources is provided. The method translates knowledge either before, or just after capture, into formats that are standard for all types and forms of data and exchanges used as embodiments of the system. The method may further comply where possible with local, state and federal as well as with the expectations and requirements of professional associations and institutions in formats as embodiments of the invention. The method may further accept, incorporate and encapsulate information into manual procedures used in any community settings where health, environmental, and any other potentially situational hazardous data may be sourced. The method may also recognize standard triage, history/physical/diagnosis and demographic forms that can be faxed, mailed, electronically mailed or communicated in any other fashion from every source immediately after being completed. In one embodiment, the method uses optical character recognition technologies as an input process into the system, with manual oversight as required; automatic feeds received from existing hospital information systems; and codes to accept and integrate information from various sources, such as biometric devices in an embodiment of the invention. The method may derive information from standard triage, history/physical/diagnosis and demographic forms; code the information to facilitate custom (OCR) capabilities geared to improve recognition and standardization in an embodiment of the invention; and write code to provide data input forms on a secured web sites as well as remote devices.

According to another aspect of the present invention, a system is provided that will enable real time multivariate analysis and multi-dimensional visualization of data trends and assessment of trends for potential intervention based on: standard definitions and the most accepted reliable methods; graphics that demonstrate differences between normal and abnormal or statistically significant states and conditions; real-time statistical analysis and modeling techniques; inherent user identification that lets visual portrayal of information produce changes in attributes, configurations and general display; and icons that are designed as easily recognizable symbols to reveal the actual statistics substantiating the case characteristics communicated and reflected by the physical depiction of attributes through known metaphors for visualization and navigation through levels of detail.

According to another aspect of the present invention, a system is provided that facilitates situation specific rapid responsiveness by providing a number of key functions including overlays of user decisions, actions, protocol generation and compliance. These overlays can take the form opaque or solid textual, graphical or mixed modality depictions.

According to another aspect of the present invention, a system is provided for enhancing real time communication and collaboration between individuals and groups separated in space and time using multiple, simultaneous modalities such as voice (spatialized, stereo or mono), video conferencing, email, chat functions etc. These modalities are deployed across a geo-specific display of the actual localities where these individuals and groups are working. The system aids communication and collaboration through the use of visual and graphical vertical hierarchies of links, navigation through multiple levels of detail and indicators of horizontal relationships (e.g., across organizations, functions, agencies, geographies, individuals, etc.). These multiple views are nested within multi-dimensional visual frames that are controlled systematically by key attributes such as security and resource priority rankings in one embodiment of the system.

According to another aspect of the present invention, a system is provided that utilizes unique methods and algorithms to interpret trends and alert different classes of end-users as to a situation's nature and causative probability. The system then presents best approaches to employ for further delineation of the scope and scale of the perceived threats as a result of advanced simulations that are provided data points from the multiple data sources. It also provides best practice advisories to guide end-users in appropriate responses to identified threat prospects.

According to another aspect of the present invention, a system is provided that enables optimal outcomes for different classes of users by providing context sensitive community views that operate with continual updates of community based data and information to improve the speed and appropriateness of decision-making and intervention management.

According to another aspect of the present invention, a method for emergency response is provided, and includes the steps of: acquiring data regarding a potential emergency situation; detecting the existence, scale and scope of an emergency situation based on the acquired data; providing advisories as to how best to respond to a detected emergency situation; and communicating data regarding the detected emergency situation for collaborative situation assessment and response planning.

These and other aspects, features and advantages of the present invention, as well as the invention itself, will be best understood from the following drawings and detailed description.

DETAILED DESCRIPTION OF THE EMBODIMENTS

The present invention will now be described in detail with reference to the drawings, which are provided as illustrative examples of the invention so as to enable those skilled in the art to practice the invention. Notably, the implementation of certain elements of the present invention may be accomplished using software, hardware, firmware or any combination thereof, as would be apparent to those of ordinary skill in the art, and the figures and examples below are not meant to limit the scope of the present invention. Moreover, where certain elements of the present invention can be partially or fully implemented using known components, only those portions of such known components that are necessary for an understanding of the present invention will be described, and detailed descriptions of other portions of such known components will be omitted so as not to obscure the invention. Preferred embodiments of the present invention are illustrated in the Figures, like numerals being used to refer to like and corresponding parts of various drawings.

Figure 1:
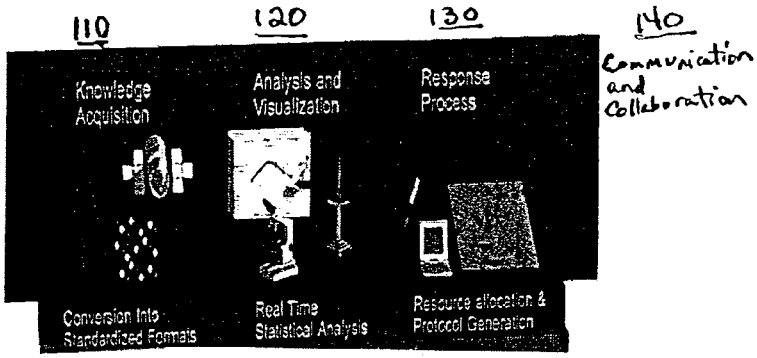
FIG. 1 illustrates a general method for emergency response, according to the present invention.

FIG. 1 illustrates a general system and method 100 for emergency response, according to the present invention. The system and method 100 of the invention may be divided into four inter-related components or steps 110-140, each linked by a set of relevant inputs, transformation activities and outcomes.

Method 100 includes the following steps: (i) step 110, Surveillance and Knowledge Acquisition, including Data Input, Collection and Collation, Conversion Into Standardized Format, and Uniform Data & Information; (ii) step 120, Detection—Analysis and Visualization, including Access to Standard Data and Information, Real Time Statistical Analysis, and Customized User Presentation Views; (iii) step 130, Response—Rapid & Situation Specific, including Overlays of User Decisions & Actions, Protocol Generation & Compliance, and Feedback, Trend Analysis and Monitoring; and (iv) step 140, Communication and Collaboration, including User Community Views and Alerts, Dynamic Information and Decision-Making, and Shared Views, Documentation and Decisions.

Although the present invention has been described in relation to a method 100, it should be appreciated that each of the portions or blocks illustrated in FIG. 1 (as well as the portions or blocks illustrated in the other Figures) may represent the hardware and/or software utilized to perform the logic steps or processes. It should further be appreciated that any one or more of the portions or blocks shown can be implemented in a computer readable medium as part of a system. In the preferred embodiment, conventional hardware, software and/or firmware may be used to perform the logic steps and/or processes.

The foregoing steps 110-140 will now be described in greater detail.

Step 110 Surveillance—Knowledge Acquisition

The method and system of the present invention support multiple alternative data capture methods and interoperability with existing tools, ranging from basic manual feeds to the use of more sophisticated technologies (e.g., personal data devices and automated data harvesting).

In the preferred embodiment, the method and system accomplish the following:

- Collect data with minimal disruption to existing workflow:
  - Employ an intuitive user interface that minimizes training
  - Do not tax current technical resources
  - Do not require onsite maintenance
  - Utilize existing hardware where possible
- Capture data from diverse sources irrespective of data type
- Implement ISO standard data formats and structures where possible Examples of data elements collected into custom databases include:

- Basic Demographics
  - Name
  - Medical Record Number
  - Birth date
  - Sex
  - Place of Residence
  - Place of Work
  - Temperature
  - Blood Pressure
  - Pulse
  - Respiratory Rate
  - Level of Pain
  - Pulse Oximetry
  - Time and Date of Arrival to the care provider
  - Mode of Arrival
  - Chief Complaint
  - Symptoms
  - Limited Past Medical History
  - Map overlay (streets, roads, freeways, community centers, waterways)
    - Commercial Pharmacy Sales
    - Prescription medication
    - Non-Prescription Medication
  - Weather Data
  - Environmental Sensor Data
  - Public Event Mapping (football games, baseball games, concerts)
  - School Attendance
  - Animal Health
    - Death
    - Illness
  - Hospital Deaths
  - Hospital Bed Status
  - Call Center Activity
  - Selected Web Site Activity The method and system will evaluate the individual datasets (child) captured and determine which can be appropriately integrated into the master dataset (parent).

The system and method have flexibility to work with alternative forms of data capture to deliver immediate benefits by providing a simple way to communicate data without burdening users with significant capital expenditures or changes to existing workflows. One embodiment of the system fully automates the data collection process. Increasing the automation of data collection provides improved data integrity and detail leading to greater detection sensitivity of less obvious threats.

The system and method conduct a thorough assessment of the specific requirements in collecting data and may employ conventional data gathering tools that acquire this data to determine the most effective-in-use process for the user. The assessment may include a process-flow analysis of methodologies used to assemble data regarding a perceived threat, the types of data collected and the expected outcomes resulting from appropriate use of that data. The system continuously reviews its performance and flexibility to handle both current and new situations prompting the end-user to initiate improvements at regular intervals.

Step 120 Detection—Analysis and Visualization

This step or component detects and communicates the scope, scale and implications of a problem in a panoply of simple, yet compelling ways to various end users based on the acquired data. In one embodiment, the system provides a set of Web-based multi-dimensional interfaces for interpreting health, environmental and socio-economic data that will help to indicate a potential biological-threat. Intuitive visualization, open standards, geographic information, and multiple data sources may be combined for flexible use by health-care professionals, emergency-service agencies and other agencies as well as the general public. This aspect of the invention incorporating an advanced visualization system has two specific advantages. First, the system is easy to use and able to display information in a format that is most useful to the viewer. Second, the system displays a large amount of information onto small display areas through the use of icons and other visual data compression tools; and the system provides the right information at the needed level. Time is always limited for health professionals and improving the access to information is the key to improved surveillance.

Figure 2:
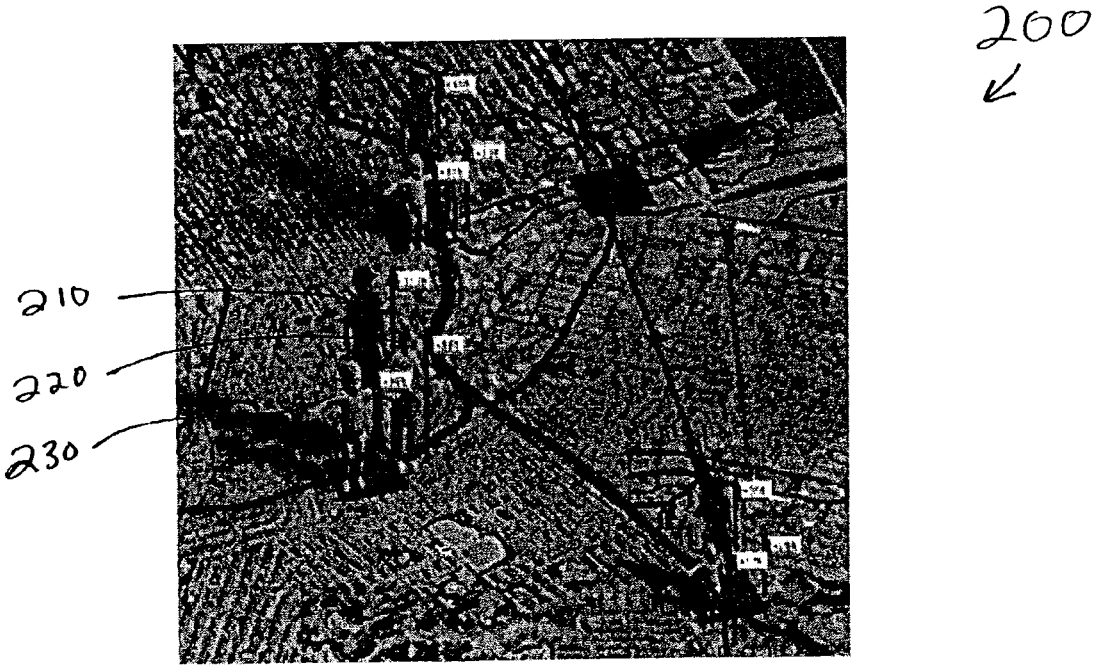
FIG. 2 is one example of a graphical user interface, which may be generated by the present invention in order to illustrate locations of potential illnesses.
Figure 3:
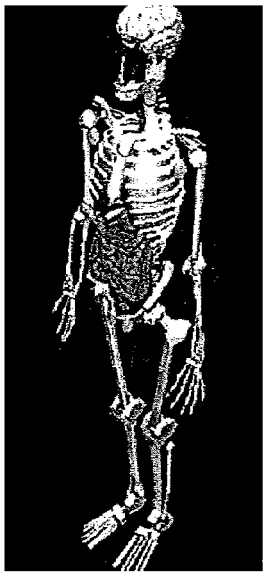
FIG. 3 is one example of a graphical user interface, which may be generated by the present invention in order to illustrate internal organ and physiological systems that are significantly affected in a given population.

As an exemplary embodiment of the system's visualization tools, FIG. 2 illustrates a graphical user interface 200 illustrating cases of potential tularemia (a potential biological weapon, which may cause individuals to exhibit high fever, sore throat, coughing up blood and having bloody diarrhea) using a pictorial representation or icon of a person. Icons can represent a number of attributes simultaneously. Examples of attributes include number of patients, age, gender, ethnicity, and income status. Icons are designed to reflect physical depiction of these attributes through easily recognizable metaphors. The icon's relative size can communicate the number of cases, while its shape or design can indicate age, gender and ethnicity. Specific numbers can be pinned to the icons or users can "drill down" by clicking on the icon to reveal the actual statistics substantiating the case characteristics communicated. For example, the figurine of a large woman 210 alongside a smaller man 220 and child 230 in FIG. 2 instantly conveys the impression of a disease with preponderance for the female gender. By selecting the figurines, the system may display the figurines in a semi-transparent manner, as shown in FIG. 3. In this manner, internal organ systems are visible, and physiological systems which are significantly affected (as determined by statistical analysis) in a given population may be highlighted. In the example of tularemia, the figurines may display highlighted three-dimensional upper airway and intestinal systems indicating that there are statistically significant increases in sore throat and diarrhea symptoms from patients at that treatment center.

The icons will also respond dynamically to changes in the data provided and to the data sets selected by the end user. This feature allows end users to direct resources to the specific problem in need of attention. If the number of potential tularemia cases is high, clinicians will be alerted to advise microbiology to test for this entity and the system will immediately report and advise on confirmed cases of this rarely occurring disease. Also, once the number, severity and distribution of cases are mapped to an area, the system will assist hospitals to organize resources and staff to best serve emergency needs.

The geographic visualization and the simultaneous examination of events provide considerable strength to the system. For instance, consider terrorists have tampered with the water supply in an area. The system might detect an unusually high number of cases of people reporting profuse diarrhea and projectile vomiting at hospitals in nearby neighborhoods. The system would show particularly large icons for patients at those hospitals on a large map of the region that a local early warning duty officer would be viewing on a screen after he had been alerted by email, pager, cell phone or any device of his choice to access the system from the nearest computer or other web enabled device. The officer on duty would have cause for concern about the cases, but would not be unduly alarmed. However, when sensors at the pumping substation serving the area also start reporting problems with the water supply, this would also be indicated on the map. The officer could then immediately see there is a serious problem and sound the alarm, with the various emergency units then rolling into action. Key to detecting bio-terror illness is the identification of symptoms appearing potentially abnormal against a continuously monitored baseline. A Systems Team may utilize an array of algorithms to assist in the identification of abnormal clusters of suspicious syndromes.

Another feature of the system and method allows end-users to explore what-if scenarios in an interactive fashion. This feature confers the advantage to end-users of the capability to predict in advance required resources and to deploy these assets cost-effectively. For example, the system will support the development display and continual updating of contingency plans for a number of possible disasters. Thus, in case of an actual disaster warning, this object of the system will assist hospitals to staff emergency departments in response to predicted volumes, deploy ambulances to locations of greatest need, and send law enforcement officers to areas of greatest potential yield as a result of simulations embedded in the system which predict such variables as crowd behavior, disease distribution, plume dispersion (in the case of a suspected airborne release of a bio-agent) and traffic flow.

Step 130 Response—Rapid and Situation Specific

The system provides each class of end-user with context sensitive advisories as how best to respond to a specific bio-challenge. For example, in a scenario similar to the anthrax attacks in late 2001, the system would advise postal workers on how best to contain cutaneous and aerosolized anthrax. Also, the system would show maps of mail carrier routes superimposed upon the overall map of the affected area to aid in rapid identification, testing and prophylaxis of affected individuals. In the case of a building contaminated with anthrax, an operator will quickly obtain and incorporate engineering data into the system and run simulations to guide decontamination workers in the most effective approaches to employ. Biosensors would be positioned and linked to the system to help monitor ventilation patterns in the buildings.

The system measures and monitors compliance with recommended best-practice protocols by end-users, regardless of location. For example, HAZMAT workers will report on their compliance in the field using wireless palm units. Situation incident commanders will check off compliance against items in a pop-up window that hovers near the incident being addressed. This feature benefits both responders and the community by providing a real-time assessment of compliance and its impact on outcomes.

Step 140 Communication and Collaboration

Critical to success in dealing with a bio-attack is the ability to coordinate efforts. In one embodiment, the fourth step or component contains a suite of powerful tools to support multiple levels of collaborative situation assessment and response planning. For example, FBI agents and other authorized officers can view a complete three-dimensional map of the affected area populated by icons that represent all the available resources deployed and indicate their capabilities. This object of the invention has the advantage of assisting end-users such as law enforcement to re-assign agents to specific areas of suspicion, or mobilize ancillary support from local law enforcement to assist in an investigation efficient manner.

In an exemplary embodiment of the system where terrorists have poisoned the water supply of a specific area, the system enables public health officers to interact live with water officials while jointly viewing a geographically accurate grid of the pipes in question superimposed over an appropriate map. This feature has the advantage of enabling rapid authorization to close interconnecting contamination points that spread the disease across traditional county and state lines, many of which share water supply sources. This feature of the invention may take many forms including dedicated multipoint and spatialized audio conferencing, videoconferencing, text communication and direct situation overlay.

Direct situation overlay (DSO) refers to an object of the system that enables participants to use digital marker pens to sketch out plans of action overlaid directly on the map of the areas under consideration. This confers significant advantages by reducing the chance of ambiguities between multiple agencies. This also has the advantage of helping to focus discussion on specific areas and support smart group decision-making. Inter-jurisdictional decisions are made faster, given broader support and implemented using available resources more effectively and efficiently. This advantage also enables each agency to facilitate interagency research and thus reinforce better allocation of resources.

Other features of the invention may include:

- A scalable system to support small to large geographically dispersed enterprises;
- Indexing, metadata extraction and hyperlink management that occur automatically when information is submitted;
- Accessibility by users from any variety of Web browser applications;
- Rules-based, automatic document filing;
- Ability to inspect queries, reports, knowledge collections and hyperlinks relevant to the user's roles;
- Multilevel access privileges granted to different classes of users;
- Self-publishing of documents by authorized users;
- 'Broadcasting' of direct content to specified end users (e.g., periodic health updates); and
- A search engine that continually scans for information on user defined topics of interest, with results displayed in the system or sent by e-mail or instant messaging.

General System Architecture

Figure 4:
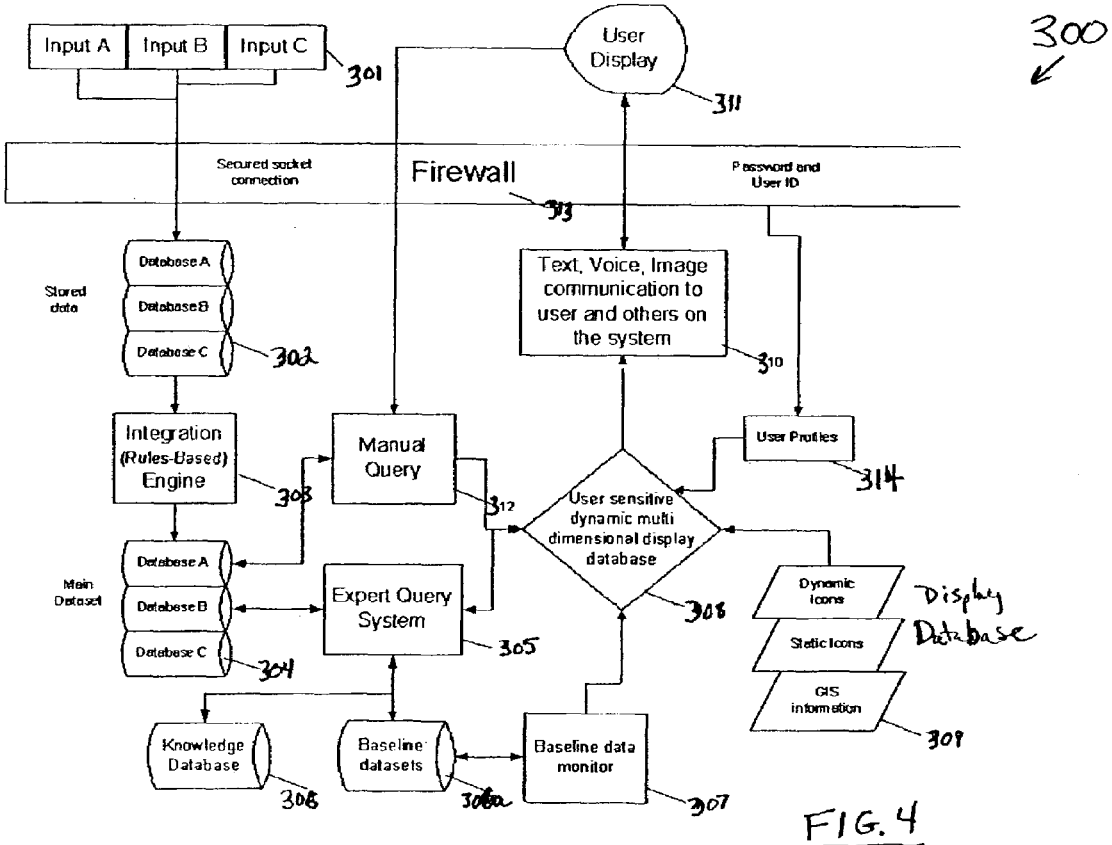
FIG. 4 is a block diagram illustrating one embodiment of a system for emergency response, according to the present invention.

FIG. 4 illustrates the general architecture of a system 300 for emergency response, according to the present invention. The data inputs 301 shown as Input A, Input B and Input C exemplify diverse sources that supply heterogeneous data into the system. These and other sources of unstructured data are uniquely collected by the invention in digital and non-digital formats. All information entering and leaving the system must pass through a secured firewall 313 and comply with federal and state requirements for privacy and security. Examples of the numerous sources of data include bio-sensors, databases of over-the-counter sales of prescribed and non-prescribed medicines, climate data, website access data, water quality, food quality data, school and work attendance data, animal health and clinical treatment center data.

Data from various input sources are placed in the Stored Databases A, B and C 302 and allow access to the data in its original format if so desired by those who supply or use it. All data collected and stored by the system is integrated and converted using standard definitions and protocols that are recognized by the appropriate expert organizations (e.g., ISO or CDC) 303 that in turn form the Main Dataset 304 that serves as the information foundation to support the invention's new, custom forms of online detection, analysis and alerts of potential occurrences of illnesses, diseases, epidemics, disasters and bio-attacks.

The Expert Query Systems 305 will periodically query the Main Dataset 304 to create Baseline Datasets 306*a*. The baseline datasets systematically update a Baseline Data Monitoring system 307 that uses advanced statistical tools to detect any statistically significant abnormality, which may indicate events that include but are not limited to the start of a possible bio-attack, an epidemic or a failure of a public health safeguard.

The Expert Query System 305 will also create a Knowledge Database 306 that can further examine trends in the Main Dataset 304. The Knowledge Database 306 will support the process of the baseline monitoring system by looking for abnormalities using more time sensitive queries.

In the event of an abnormality, the Expert Query System 305 will also send information to the User Sensitive Dynamic Multi-Dimensional Display Database 308 which filters information based on the User's Profile 314.

The Baseline Data Monitor 307 also reacts to abnormal events and sends information to the Display Engine 308; and its source of information is the Baseline Datasets 306*a*.

The Display Engine 308 takes the information it receives, filters the information according to rules that reflect user profiles and then resolves the information in an associated Display Database 309. Objects in the Display Database 309 are modified based on multiple attributes including geo-location, icon, icon display attributes, interaction rules and instructions for system queries 309.

The Communication system 310 creates code needed by the client's device to display information 311. The communication system 310 also provides components for communication with other users.

From the device provided by the user, the User Display 311, the user can explore the custom multi-dimensional dynamic icon rich environment. The icons and display windows will allow the user to activate customized queries via the Manual Query component 312. The results are sent to the Display Engine 308 and then back to the user.

Operation of the Invention

Figure 5:
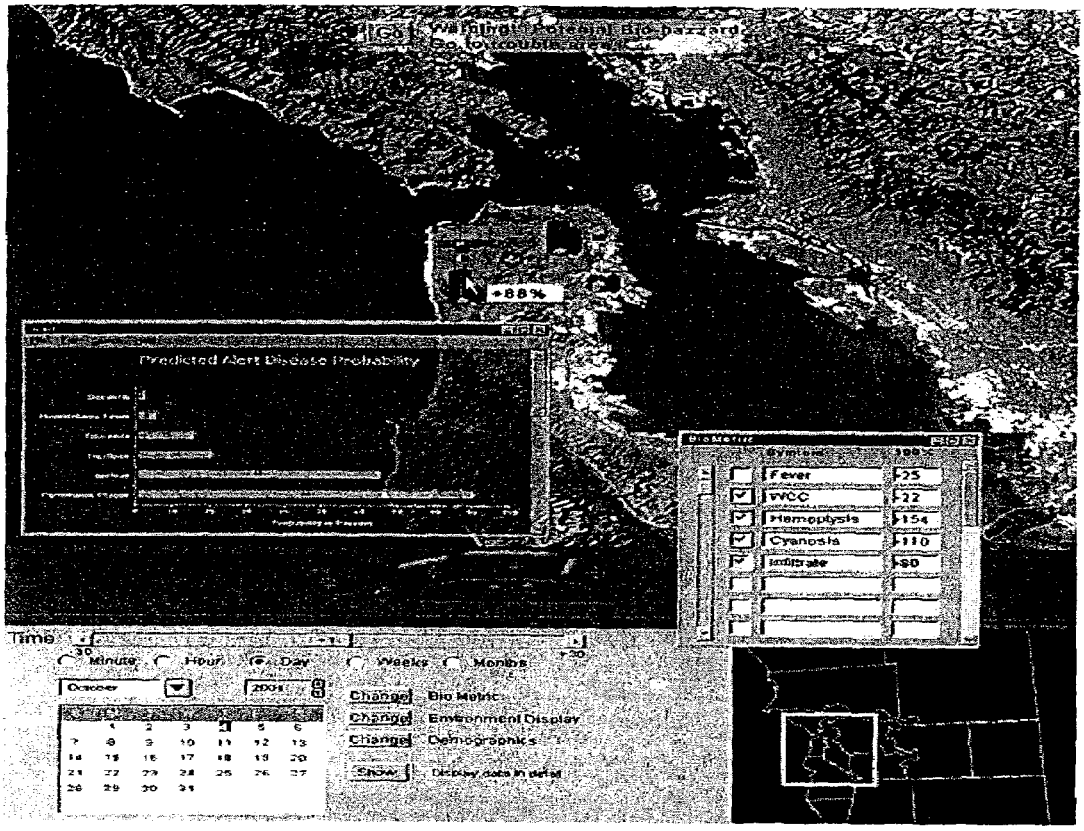
FIG. 5 is one example of a display, which may be generated by the present invention to illustrate geographical origins of symptoms that could possibly indicate a biological attack.

FIG. 5 illustrates an exemplary embodiment of a display, which may be generated by the system, and which may comprise multidimensional maps for providing constant updates of any unusual frequency of symptoms that could possibly indicate a bio-attack and highlight their possible points of origin. The views displayed are the result of clinical, environmental and customized rules, algorithms and statistics that organize and present information according to the user's profile.

Figure 6:
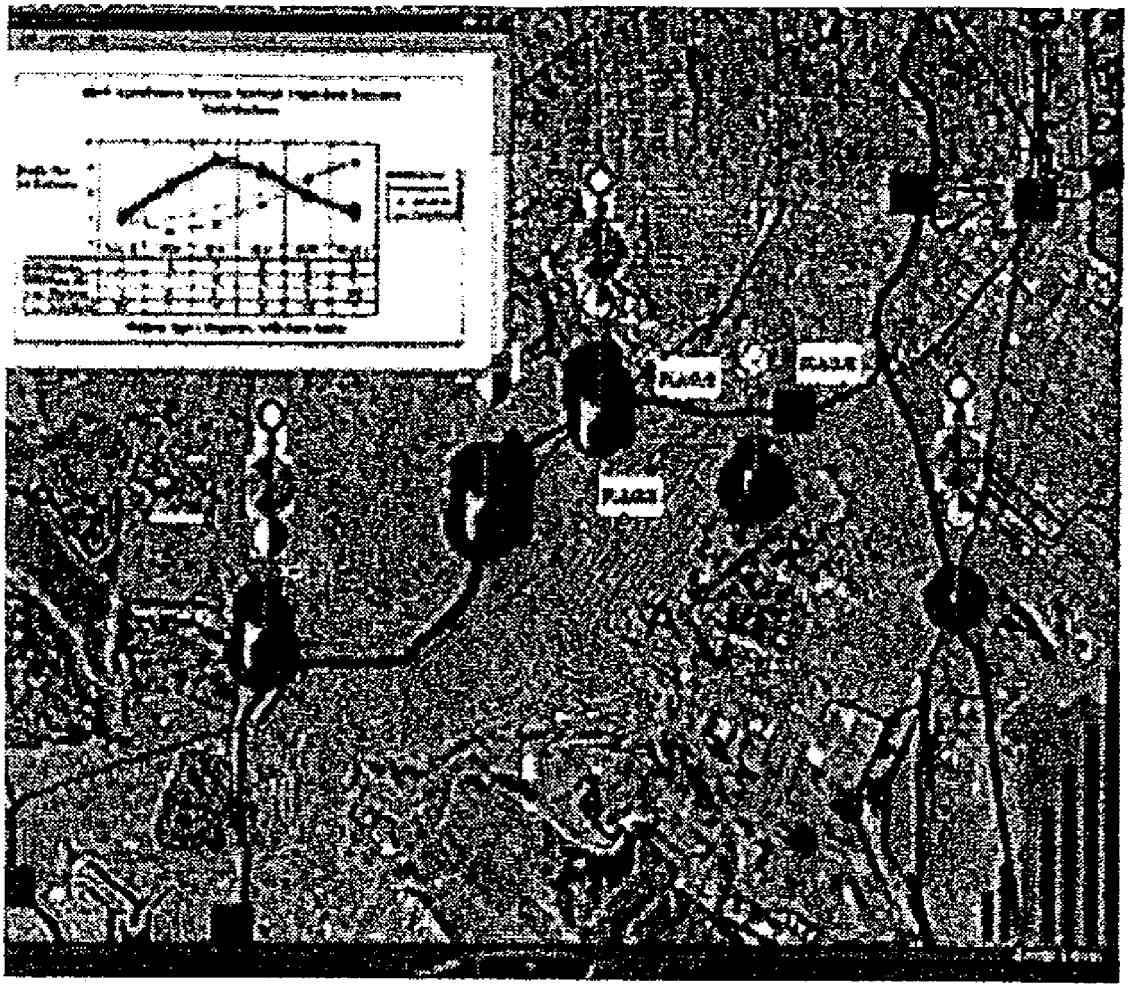
FIG. 6 is an enlarged view of a geographical area illustrated in the display shown in FIG. 5.

The system subjects the integrated data streams to a battery of advanced heuristics, algorithms and statistical analyses designed to highlight disturbing trends that may constitute the basis for potential threats. These trends are illustrated by displaying the centers of possible disease outbreaks superimposed upon a three-dimensional map of the area under scrutiny that in the display shown in FIG. 5 is the San Francisco Bay Area. FIG. 6 illustrates a zoomed or enlarged version of the area of interest. The display may also include dialogue boxes that automatically appear (pop-up) with further information on the probability of disease and the incidence of signs or symptoms that are above the respective baseline for the individual clinical site. The system operates to incorporate multi-modal alert notifications from multiple media sources, such as email, fax, paging, and text to voice phone messaging, all uniquely organized to ensure that all authorities are immediately and repetitively notified until a response has been received. Other features include the ability to change the environmental, demographic or biometric data that can be displayed on a selected geographical area.

The exemplary embodiments of the system include customized displays that operate with time-lapse animation (e.g., using a time slider) of disease trends and to enable public health and defense officers to study 'what if' scenarios based on changing weather, demographic or biometric data using advanced simulations. Instant alerts would appear as alarm icons on the multidimensional map of the geographic area of interest. Representations of weather patterns are used to display predictions of organism distribution and identify adjacent communities at risk. Both public and defense health officers would be simultaneously alerted as to the scope of the initial infestation and also directed to fallout communities.

Display objects operate to achieve:

Easily scalable bio-surveillance architecture;

Data mapping and data merging (fusion) capabilities;

Probabilistic detection algorithms that utilize multi-source data including weather, absenteeism, web queries, and clinical data;

A modeling and simulation capability developed with agent-based technology;

Technical and policy solutions for the protection of privacy; and

Quickly customized prototype detection applications to design and test the invention's operation before a full-scale implementation.

In one exemplary embodiment of the invention, the system enables a best defense against bio-terrorism by way of effective surveillance, rapid recognition and incisive intervention. This invention meets the challenge through a dynamic simulation and visualization platform that creates unified access and exchange of information across diverse geographical areas. The system makes interaction, communication and collaboration on complex issues easier, intuitive, insightful, and useable. It provides all facets serving public health and safety with both effective and efficient surveillance by collecting and standardizing existing, multiple data streams. As an exemplary embodiment of the system's rapid recognition capabilities, advanced heuristics and algorithms may be incorporated to identify alarming trends or 'threat prospects' and a display of these within a clear, logical and decision-oriented structure using advanced information visualization techniques. The system supports incisive intervention with the provision of context sensitive decision support advisories to appropriate authorities across diverse venues and with real time sharing of information in a collaborative environment to facilitate rapid and appropriate intervention.

While the invention has been particularly shown and described with respect to illustrative and preferred embodiments thereof, it will be understood by those skilled in the art that the foregoing and other changes in form and details may be made therein without departing from the spirit and scope of the invention that should be limited only by the scope of the appended claims.

What is claimed is:

1. A method for emergency response, comprising:

acquiring data regarding a potential emergency situation from a plurality of heterogeneous sources selected from the group of sources composed of mobile sensing and communicating devices, fixed sensing and communicating devices, private databases, public databases and third-party information systems, including medical and non-medical data from medical and non-medical sources potentially indicative of a biological emergency;

communicating the data directly from two or more of the plurality of heterogeneous sources in an automated manner;

integrating the acquired data into a common data model that allows for subsequent analysis and presentation;

detecting or predicting the existence, scale and scope of an emergency situation by correlative analysis of the integrated data, by use of one or more computer systems;

providing advisories as to how best to respond to a detected or predicted emergency situation;

communicating data regarding the detected or predicted emergency situation for collaborative situation assessment and response planning; and generating a multidimensional graphical user interface for allowing a user to visually interpret the acquired data.

2. The method of claim 1 wherein the potential emergency situation comprises a terror attack.

3. The method of claim 2 where in the biological emergency comprises a biological terror attack.

4. The method of claim 1 wherein the medical data includes patient demographics and symptoms.

5. The method of claim 1 where in the step of acquiring data is fully automated.

6. The method of claim 1 wherein the multidimensional graphical user interface includes pictorial representations indicating the number of patients in a geographical area, patient demographics, and patient symptoms.

7. The method of claim 1 where in the advisories include ways to best contain a biological agent.

8. The method of claim 1 wherein the step of communicating data regarding the detected emergency situation for collaborative situation assessment and response planning, includes generating an interactive map illustrating an affected area and available resources within the affected area.

9. A system for responding to a biological emergency comprising:

a plurality of inputs from two or more sources selected from the group of sources composed of mobile sensing and communicating devices, fixed sensing and communicating devices, private databases, public databases and third-party information systems for providing heterogeneous data that may be indicative of a biological emergency, including medical and non-medical data from medical and non-medical sources potentially indicative of a biological emergency;

a plurality of databases for storing the data;

an integrating portion for integrating the data into a common data model that allows for subsequent analysis and presentation;

a monitoring portion that automatically receives the heterogeneous data directly from a laurel of sources of the heterogeneous data, communicates with the databases and monitors the data, wherein the monitoring portion correlates and analyzes the integrated data in order to detect statistical abnormalities within the data model indicating a possible biological emergency, and transmits data regarding statistical abnormalities;

a display engine that is adapted to receive the data regarding the statistical abnormalities, and to filter the data according to a user profile in order to determine which data to display to a user; and, a communication system that is adapted to receive the filtered data from the display engineer and to transmit the data for display on a user device.

10. The system of claim 9 where in the biological emergency comprises a biological terror attack.

11. The system of claim 9 wherein the plurality of inputs includes one or more items selected from the group consisting of bio-sensors, databases of sales of medicines, climate data, website access data, water quality data, food quality data, school and work attendance data, animal health data, and clinical treatment data.

12. The system of claim 9 further comprising a multidimensional graphical interface that is displayed on the user display device.

13. The system of claim 12 wherein the multidimensional graphical interface comprises multidimensional maps for displaying unusual frequencies of symptoms that may be indicative of a biological emergency.

14. The system of claim 9 wherein the communication system is further adapted to generate multi-modal alert notifications to authorities regarding an emergency situation.

15. The system of claim 14 where in the multi-modal alert notifications comprise items selected from the group consisting of emails, faxes, pages, and text-to-voice phone messaging.

* * * * *